US008909106B2

(12) United States Patent
Kitada

(10) Patent No.: US 8,909,106 B2
(45) Date of Patent: Dec. 9, 2014

(54) DEVELOPING DEVICE INCLUDING BLADE FOR REGULATING A DEVELOPER LAYER

(75) Inventor: Tomo Kitada, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 238 days.

(21) Appl. No.: 13/424,768

(22) Filed: Mar. 20, 2012

(65) Prior Publication Data

US 2012/0243912 A1 Sep. 27, 2012

(30) Foreign Application Priority Data

Mar. 22, 2011 (JP) ..... 2011-062355

(51) Int. Cl.
*G03G 15/09* (2006.01)
*G03G 15/08* (2006.01)

(52) U.S. Cl.
CPC ..... *G03G 15/081* (2013.01); *G03G 15/09* (2013.01)
USPC ..... 399/257; 399/274

(58) Field of Classification Search
CPC ..... G03G 15/0822; G03G 15/0832; G03G 15/0834; G03G 15/0839; G03G 15/09; G03G 2212/0685; G03G 2215/0802
USPC ..... 399/254, 255, 267, 272–274
See application file for complete search history.

(56) References Cited

U.S. PATENT DOCUMENTS

| | | | | |
|---|---|---|---|---|
| 5,758,241 | A * | 5/1998 | Oyama et al. | 399/272 |
| 5,771,426 | A * | 6/1998 | Oka et al. | 399/267 |
| 6,337,957 | B1 | 1/2002 | Tamaki et al. | |
| 6,522,855 | B1 | 2/2003 | Terai et al. | |

FOREIGN PATENT DOCUMENTS

| | | |
|---|---|---|
| JP | 63-118777 A | 5/1988 |
| JP | 3-116072 A | 5/1991 |
| JP | 2001-092249 | 4/2001 |
| JP | 2005-017935 | 1/2005 |
| JP | 2006-309261 | 11/2006 |
| JP | 2008-102544 | 5/2008 |

OTHER PUBLICATIONS

Office Action (Notification of Reasons for Refusal) issued by the Japanese Patent Office on Apr. 23, 2013, in the corresponding Japanese Patent Application No. 2011-062355, and an English Translation thereof. (6 pages).

* cited by examiner

*Primary Examiner* — William J Royer
(74) *Attorney, Agent, or Firm* — Buchanan Ingersoll & Rooney PC

(57) ABSTRACT

A developing device for forming a toner image on an image support member with a developer composed of toner and carriers, the developing device having: a main body in which a first space for a developer is made; a developer support member, which is located in the first space, for supporting the developer and for supplying toner of the developer to the image support member; and a toner tank in which a second space for toner is made, the second space leading to the first space via at least one boundary area; wherein the at least one boundary area between the first space and the second space is closed by the toner or the developer.

4 Claims, 5 Drawing Sheets

DEVELOPING DEVICE INCLUDING BLADE FOR REGULATING A DEVELOPER LAYER

This application is based on Japanese Patent Application No. 2011-062355 filed on Mar. 22, 2011, the content of which is incorporated herein by reference.

BACKGROUND OF THE INVENTION

1. Field of the Invention

The present invention relates to a developing device, and more particularly to a developing device for forming a toner image on a photoreceptor.

2. Description of Related Art

An example of conventional developing devices is a developing device disclosed by Japanese Patent Laid-Open Publication No. 2005-17935. FIG. 10 is a skeleton framework of a developing device 500 disclosed by Japanese Patent Laid-Open Publication No. 2005-17935, and with reference to FIG. 10, the developing device 500 is described below.

In the developing device 500, a developer tank 504 is arranged adjacent to a developer support member 503. The developer tank 504 is connected with a toner tank 505 via a toner supply path 506. Further, a developer saving portion 507 and a developer separator 509 are provided. A detour 508 to the developer tank 504 is made in the developer saving portion 507. The developer separator 509 blocks a surplus part of a two-component developer 502 supported and supplied by the developer support member 503 and guides the surplus part of the two-component developer 502 to the developer tank 504 or to the developer saving portion 507 depending on the toner concentration in the developer tank 504. Moreover, a connection 513 to the toner tank 505 is formed in the developer saving portion 507. In this structure, the two-component developer 502 fed to the developer saving portion 507 can flow to the developer tank 504 and to the toner tank 505.

In the developing device 500, when the toner concentration in the developer tank 504 is low, the two-component developer 502 is temporarily guided to the developer saving portion 507, and thereby, a volume change and a flow of the two-component developer 502 are stressed. Accordingly, the developer tank 504 can take in the two-component developer with a high toner concentration from the toner tank 505 quickly. In this way, the speed of taking toner into the developer tank 504 increases, and the developing device 500 can perform continuous printing of high-density images.

In the developing device 500 disclosed by Japanese Patent laid-Open Publication No. 2005-17935, however, has a problem that the ratio by weight of toner to the developer (which will be hereinafter referred to as TC ratio) is easy to fluctuate. More specifically, in the developing device 500, the developer tank 504 and the toner tank 505 are connected to each other via the toner supply path 506 and the detour 508, and the carriers of the two-component developer 502 fed to the developer saving portion 507 move to the toner tank 505 via the detour 508. As the carriers are moving to the toner tank 505, the carriers in the developer tank 504 are decreasing, and the TC ratio in the developer tank 504 becomes higher.

SUMMARY OF THE INVENTION

An embodiment of the present invention is a developing device for forming a toner image on an image support member with a developer composed of toner and carriers, and the developing device comprises; a main body in which a first space for a developer is made; a developer support member, which is located in the first space, for supporting the developer and for supplying toner of the developer to the image support member; and a toner tank in which a second space for toner is made, the second space leading to the first space via at least one boundary area; wherein the at least one boundary area between the first space and the second space is closed by the toner or the developer.

BRIEF DESCRIPTION OF THE DRAWINGS

This and other features of the present invention will be apparent from the following description with reference to the accompanying drawings, in which.

DETAILED DESCRIPTION OF THE PREFERRED EMBODIMENTS

A developing device 7 according to an embodiment of the present invention is hereinafter described with reference to the accompanying drawings.

Structure of Image Forming Apparatus

Figure 1:
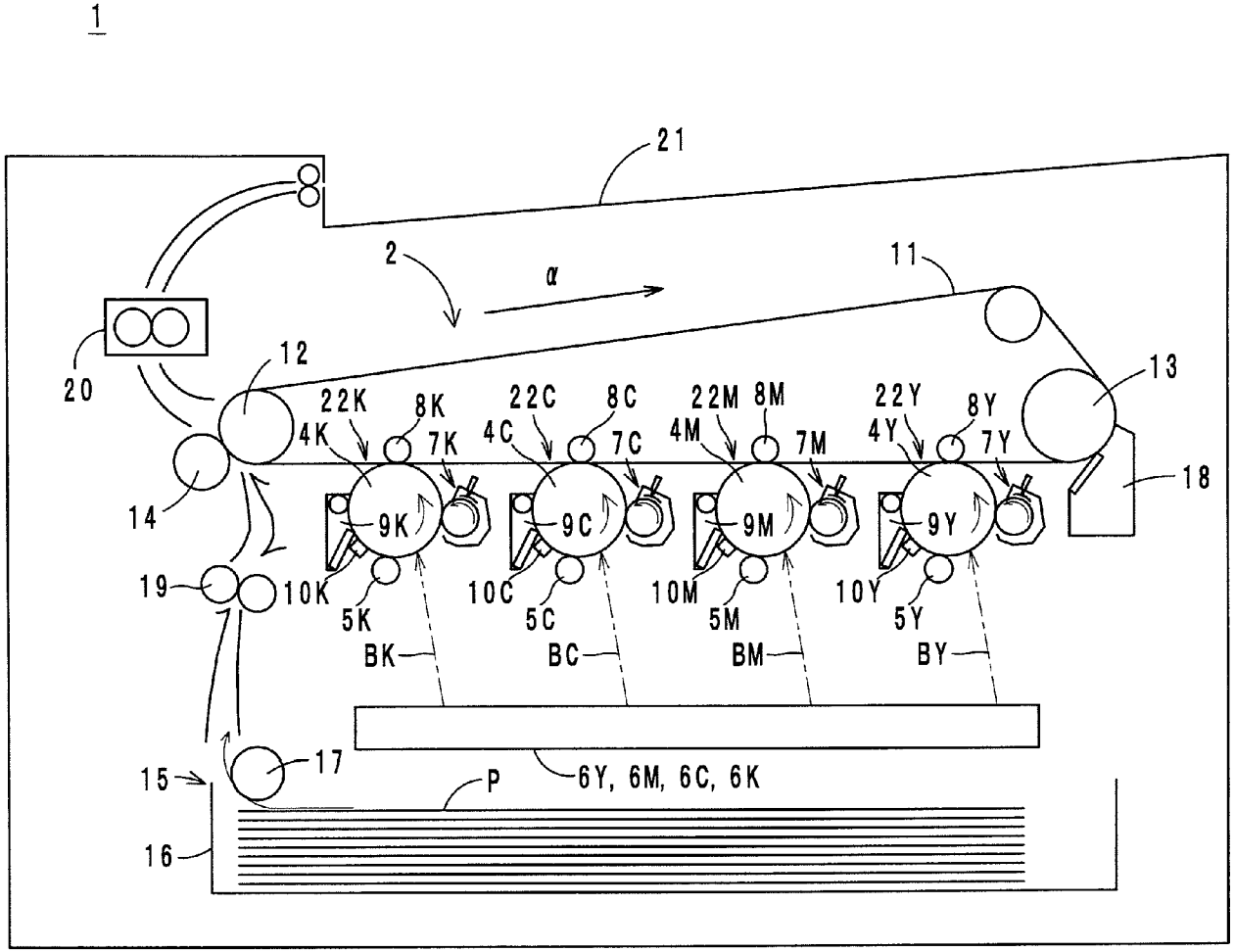
FIG. 1 is a skeleton framework of an image forming apparatus.

First, an image forming apparatus 1 provided with a developing device 7 according to an embodiment of the present invention is described. FIG. 1 shows the overall structure of the image forming apparatus 1.

The image forming apparatus 1 is an electrophotographic color printer and combines images of four colors, namely, yellow (Y), magenta (M), cyan (C) and black (K) by a tandem method. The image forming apparatus 1 forms an image in accordance with image data read with a scanner on a sheet (print medium) P by using a developer composed of toner and magnetic carriers (which will be referred to as merely carriers). As shown by FIG. 1, the image forming apparatus 1 comprises a printing section 2, a feeding section 15, a pair of timing rollers 19, a fixing device 20 and a printed-sheet tray 21.

The feeding section 15 feeds sheets of a print medium P one by one. The feeding section 15 comprises a sheet tray 16 and a feed roller 17. On the sheet tray 16, a plurality of sheets P to be subjected to printing are stacked. The feed roller 17 picks up one sheet from the stack of sheets P on the sheet tray 16. The pair of timing rollers 19 feeds the sheet P forward in synchronized timing so that a toner image will be transferred onto the sheet P at the printing section 2.

The printing section 2 forms a toner image on the sheet P fed from the feeding section 15. The printing section 2 comprises image formation units 22 (22Y, 22M, 22C, 22K), optical scanning devices 6 (6Y, 6M, 6C, 6K), transfer devices 8 (8Y, 8M, 8C, 8K), an intermediate transfer belt 11, a driving roller 12, a driven roller 13, a secondary transfer roller 14 and a cleaning device 18. The image formation units 22 (22Y, 22M, 22C, 22K) each have a photosensitive drum (an image support member) 4 (4Y, 4M, 4C, 4K), a charger 5 (5Y, 5M, 5C, 5K), a developing device 7 (7Y, 7M, 7C, 7K), a cleaner 9 (9Y, 9M, 9C, 9K) and an eraser 10 (10Y, 10M, 100, 10K).

The photosensitive drums 4 (4Y, 4M, 4C, 4K) are cylindrical and are driven to rotate counterclockwise as shown in FIG. 1. The chargers 5 electrically charge the peripheral surfaces (photoreceptor surfaces) of the photosensitive drums 4. The optical scanning devices 6 are controlled by a control unit (not shown) to irradiate the peripheral surfaces of the photosensitive drums 4 with beams BY, BM, BC and BK, and thereby, electrostatic latent images are formed on the peripheral surfaces of the photosensitive drums 4.

The developing devices 7 develop the electrostatic latent images into toner images with a developer composed of toner and carriers. The developing devices 7 will be described in more detail later.

The intermediate transfer belt 11 is stretched between the driving roller 12 and the driven roller 13, and the toner images formed on the photosensitive drums 4 are transferred onto the intermediate transfer belt 11 (primary transfer). More specifically, the transfer devices 8 are disposed to face the inner surface of the intermediate transfer belt 11, and with a primary transfer voltage applied thereto, the transfer devices 8 transfer the toner images formed on the photosensitive drums 4 onto the intermediate transfer belt 11 such that the toner images are combined into a composite toner image on the intermediate transfer belt 11. The cleaners 9 collect residual toner remaining on the peripheral surfaces of the photosensitive drums 4 after the primary transfer. The erasers 10 erase the charge from the peripheral surfaces of the photosensitive drums 4. The driving roller 12 is rotated by an intermediate transfer belt driving section (not shown) and drives the intermediate transfer belt 11 in a direction shown by arrow $\alpha$. Thereby, the intermediate transfer belt 11 carries the composite toner image to the secondary transfer roller 14.

The secondary transfer roller 14, which is cylindrical, is opposed to the intermediate transfer belt 11. A transfer voltage is applied to the secondary transfer roller 14, and thereby, the composite toner image carried by the intermediate transfer belt 11 is transferred onto a sheet P passing through between the intermediate transfer belt 11 and the secondary transfer roller 14 (secondary transfer). More specifically, the driving roller 12 has an electric potential on the ground level, and the intermediate transfer belt 11, which is in contact with the driving roller 12, has a positive electric potential near the ground level. A positive transfer voltage to make the electric potential of the secondary transfer roller 14 higher than those of the driving roller 12 and the intermediate transfer belt 11 is applied to the secondary transfer roller 14. Then, since the toner image is charged negative, the toner image is transferred from the intermediate transfer belt 11 to the sheet P via an electric field generated between the driving roller 12 and the secondary transfer roller 14.

The cleaning device 18 removes residual toner from the intermediate transfer belt 11 after the secondary transfer of the toner image to the sheet P.

The sheet P with the toner image transferred thereon is fed to the fixing device 20. The fixing device 20 performs a heating treatment and a pressing treatment toward the sheet P, and thereby, the toner image is fixed on the sheet P. Thereafter, the sheet P is ejected onto the printed-sheet tray 21.

Structure of the Developing Device

Figure 2:
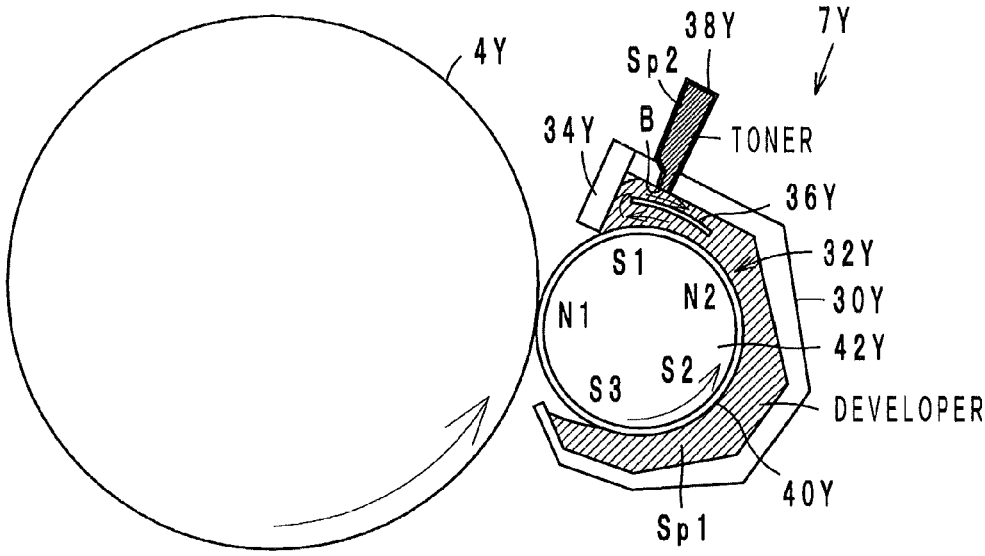
FIG. 2 is a structural drawing of a developing device.

Next, the structure of the developing devices 7 (7Y, 7M, 7C, 7K) is described with reference to the drawings. FIG. 2 shows the structure of the developing device 7Y. Since all the developing devices 7Y, 7M, 7C and 7K are of the same structure, the developing device 7Y will be described in the following as an example.

As shown in FIG. 2, the developing device 7Y comprises a main body 30Y, a developing roller 32Y, a blade 34Y, a current plate 36Y and a toner tank 38Y.

The main body 30Y is the main part of the developing device 7Y. In the main body 30Y, a space Sp1 for a developer composed of toner and carriers is made. The space Sp1 has a volume that is, for example, substantially equal to the volume of the developer with a TC ratio of an upper limit (for example, 8%). The TC ratio means the ratio by weight of toner to the developer. A TC ratio that permits formation of a toner image with a sufficient density and that prevents fogging (for example, 7%) is predetermined as the optimal value for the TC ratio. The volume of the space Sp1 means the volume of the region in which the developer moves around within the space Sp1. An opening is made in the main body 30Y at a portion facing the photosensitive drum 4Y.

The developing roller 32Y is a developer support member provided in the space Sp1 of the main body 30Y. The developing roller 32Y supports the developer thereon and supplies toner of the developer to the peripheral surface of the photosensitive drum 4Y. The developing roller 32Y also works to stir the developer to charge the toner to a negative potential. The developing roller 32Y comprises a sleeve 40Y and a magnet 42Y.

The sleeve 40Y is, as shown in FIG. 2, a non-magnetic metal cylinder and faces the photosensitive drum 4Y. The sleeve 40Y rotates in the same direction as the photosensitive drum 4Y, that is, rotates counterclockwise.

As shown by FIG. 2, the magnet 42Y, which is provided in the sleeve 40Y, has magnetic poles N1, S1, N2, S2 and S3. The magnetic pole N1 is opposed to the photosensitive drum 4Y. The magnetic poles N1, S1, N2, S2 and S3 are arranged clockwise in this order. The magnet 42Y attracts the carriers of the developer, and thereby, the developer is held on the peripheral surface of the sleeve 40Y.

The developing roller 32Y of the structure above attracts the carriers to the peripheral surface of the sleeve 40Y with the force of the magnetic pole S2. Simultaneously, toner adhering to the carriers is also attracted to the sleeve 40Y. Thus, the developer is attracted to the peripheral surface of the sleeve 40Y and is conveyed with rotation of the sleeve 40Y. In the meantime, the developer is held on the peripheral surface of the sleeve 40Y by the magnetic field between the magnetic poles S2 and N2, the magnetic field between the magnetic poles N2 and S1 and the magnetic field between the magnetic poles S1 and N1. The blade 34Y is located upstream, with respect to the rotating direction of the sleeve 40Y, from a closest point where the photosensitive drum 4Y and the sleeve 40Y are closest to each other. Thereby, the blade 34Y regulates the developer layer on the peripheral surface of the sleeve 40Y to a specified thickness. Further, the toner of the developer, as will be described later, moves from the sleeve 40Y to the photosensitive drum 4Y by a magnetic field generated between the photosensitive drum 4Y and the sleeve 40Y. Thereby, a toner image is formed on the peripheral surface of the photosensitive drum 4Y.

After passing through between the photosensitive drum 4Y and the sleeve 40Y, the developer is held and conveyed continuously by the sleeve 40Y by the magnetic field between the magnetic poles N1 and S3. Thereafter, the developer is separated from the sleeve 40Y by the magnetic field between the magnetic poles S3 and S2.

Now, the process of forming a toner image on the photosensitive drum 4Y is described in more detail. A DC voltage is applied to the sleeve 40Y so that the electrostatic latent image can be developed with toner of the developer held on the sleeve 40Y. This is described in more detail below. The charger 5Y charges the peripheral surface of the photosensitive drum 4Y to a potential of −650V, and thereafter, the potential on the portion irradiated with the beam BY becomes almost 0V. Meanwhile, the peripheral surface of the sleeve 40Y keeps a potential of −500V. Therefore, between the sleeve 40Y and the portion of the photosensitive drum 4Y that was irradiated with the beam BY, an electric field from the portion irradiated with the beam BY to the sleeve 40Y is generated. Therefore, the negative-charged toner moves from the sleeve 40Y to the portion of the photosensitive drum 40Y irradiated with the beam BY. On the other hand, between the sleeve 40Y and the portion of the photosensitive drum 4Y that was not irradiated with the beam BY, an electric field from the sleeve 40Y to the portion that was not irradiated with the beam BY is generated. Therefore, the negative-charged toner does not move from the sleeve 40Y to the portion of the photosensitive drum 40Y that was not irradiated with the beam BY. In this way, a toner image is formed on the photosensitive drum 4Y in accordance with the electrostatic latent image.

The toner tank 38Y contains toner therein and supplies the toner to the main body 30Y. More specifically, when the TC ratio in the space Sp1 is below the optimal value, the toner is supplied from the toner tank 38Y to the developer in the space Sp1.

A space Sp2 for toner is made in the toner tank 38Y, and the space Sp2 leads to the space Sp1 via one or more boundary areas. In the developing device 7, the space Sp2 and the space Sp1 connect to each other via one boundary area B.

More specifically, a through-hole connecting the space Sp1 to the outside is made in the upper side of the main body 30Y, and the toner tank 38Y has an opening at the end. The end of the toner tank 38Y is inserted in the through-hole made in the upper side of the main body 30Y. Thereby, the space Sp1 and the space Sp2 connect to each other. Since the toner tank 38Y is attached to the upper side of the main body 30Y, the boundary area B between the space Sp1 and the space Sp2 is located above the center of the developing roller 32 and located upstream, with respect to the rotating direction of the sleeve 40Y, from the blade 34Y. Further, at the boundary area B, the space Sp2 is on top of the space Sp1.

Figure 3:
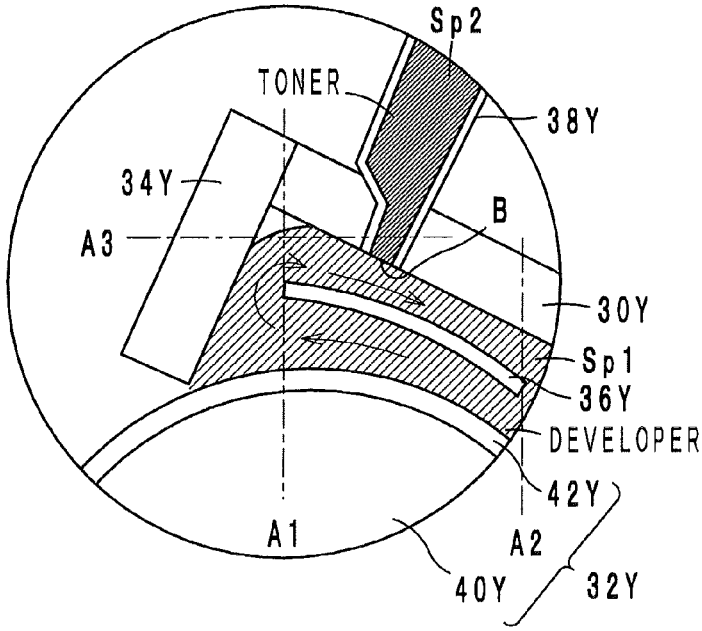
FIG. 3 is an enlarged view of the developing device, showing a state where the TC ratio is an optimal value.

Next, the current plate 36Y is described with reference to the drawings. FIG. 3 is an enlarged view of the developing device 7Y in a state where the TC ratio is the optimal value. As shown in FIG. 3, the current plate 36Y is an arched plate that is provided in the space Sp1 along the peripheral surface of the developing roller 32Y. The current plate 36Y is located above the developing roller 32Y. There is a gap between the blade 34Y and the downstream end, with respect to the rotating direction of the sleeve 40Y, of the current plate 36Y. In this structure, as the sleeve 40Y is rotating, as shown by FIG. 3, the developer between the current plate 36Y and the sleeve 40Y flows in the rotating direction of the sleeve 40Y. The blade 34Y blocks the flow of the developer. The blocked developer, that is, a surplus developer comes around between the current plate 36Y and the upper surface of the main body 30Y through the gap between the downstream end of the current plate 36Y and the blade 34Y. Then, the surplus developer flows between the upper surface of the main body 30Y and the current plate 36Y in the direction opposite to the rotating direction of the sleeve 40Y. When the TC ratio is the optimal value, the space between the upper surface of the main body 30Y and the current plate 36Y is substantially filled with the surplus developer.

As shown by FIG. 3, the boundary area B between the space Sp1 and the space Sp2 is located between a vertical line A1 passing the downstream end of the current plate 36Y and a vertical line A2 that is the farthest from the vertical line A1 among vertical lines passing the current plate 36Y. Also, the boundary area B is located below the level of a developer surface A3 when the TC ratio is the optimal value. Therefore, as shown in FIG. 3, the boundary area B between the space Sp1 and the space Sp2 is closed by the toner and the developer. When the TC ratio is the optimal value, the surrounding portions of the boundary area B are filled with the developer. Then, pressure is applied from the developer to the toner, and the interface between the developer and the toner is located at the boundary area B. Accordingly, when the TC ratio is the optimal value, a relatively small amount of toner is supplied to the developer. When the TC ratio is higher than the optimal value, the pressure applied from the developer to the toner is high, and almost no toner is supplied to the developer.

Figure 4:
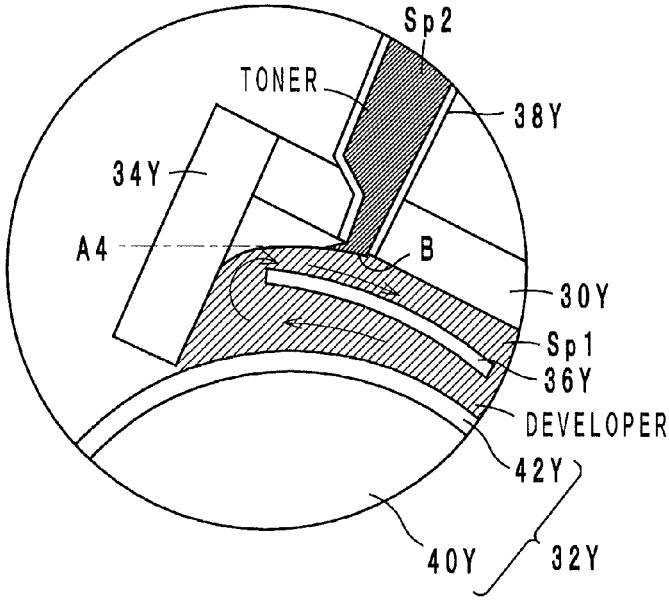
FIG. 4 is an enlarged view of the developing device, showing a state where the TC ratio is below the optimal value.

Next, the flow of the developer when the TC ratio is lower than the optimal value is described. FIG. 4 is an enlarged view of the developing device 7Y when the TC ratio is lower than the optimal value.

When the TC ratio is lower than the optimal value, the volume of the developer decreases, and as shown by FIG. 4, the level of the developer surface comes down from A3 (shown in FIGS. 3) to A4. Accordingly, the volume of the developer around the boundary area B decreases, and the pressure applied from the developer to the toner becomes lower. Thereby, the toner flows into the developer. Thus, when the TC ratio is lower than the optimal value, a relatively large amount of toner is supplied to the developer.

Advantages

In the developing device 7 of the structure above, fluctuation of the TC ratio can be suppressed. As shown by FIGS. 2 to 4, the boundary area B between the space Sp1 and the space Sp2 is closed by the toner and the developer. Therefore, the carriers of the developer hardly leak from the space Sp1 to the space Sp2, and in the developing device 7, a rise in the TC ratio due to a decrease of the carriers hardly occurs. Thus, fluctuation of the TC ratio in the developing device 7 can be suppressed.

There is another reason for the suppression of fluctuation of the TC ratio in the developing device 7. The specific gravity of the carriers is greater than that of the toner, and at the boundary area B, the space Sp2 filled with the toner is located on top of the space Sp1 filled with the developer including the carriers. For this reason, the carriers hardly leak from the space Sp1 to the space Sp2, and in the developing device 7, a rise in the TC ratio due to a decrease of the carriers hardly occurs. Thus, fluctuation of the TC ratio in the developing device 7 can be suppressed.

There is still another reason for the suppression of fluctuation of the TC ratio in the developing device 7. The boundary area B is located above the center of the sleeve 40Y. The pressure applied from the developer to the toner when the boundary area B is located above the center of the sleeve 40Y is smaller than the pressure applied from the developer to the toner when the boundary area B is located below the center of the sleeve 40Y. Especially in the developing device 7, since the boundary area B is located in the upper part of the main body 30Y, the pressure applied from the developer to the toner is extremely small. Therefore, in the developing device 7, the carriers hardly leak from the space Sp1 to the space Sp2, and a rise in the TC ratio due to a decrease of the carriers hardly occurs. Thus, fluctuation of the TC ratio in the developing device 7 can be suppressed.

In the developing device 7, moreover, toner is supplied from the toner tank 38Y to the main body 30Y sufficiently as will be described later. Therefore, even if toner images with high coverage are formed continuously, paling of the toner images due to a shortage of toner can be suppressed.

In the developing device 7, further, the current plate 36Y is provided, and the boundary area B between the space Sp1 and the space Sp2 is located between the lines A1 and A2 as shown in FIG. 3. Therefore, the toner supplied from the toner tank 38Y does not reach the sleeve 40Y directly but reaches the sleeve 40Y after being conveyed on the current plate 36Y and simultaneously mixed with the developer. Thereby, the developer with a TC ratio nearly equal to the optimal value is held on the sleeve 40Y. Consequently, with the developing device 7, paling and fogging of toner images can be suppressed.

Further, the boundary area B is located below the level of the developer surface A3 when the TC ratio is the optimal value. Accordingly, as shown by FIG. 3, the boundary area B between the space Sp1 and the space Sp2 is closed by the toner and the developer. When the TC ratio is the optimal value, the surrounding portions of the boundary area B are filled with the developer. Then, pressure is applied from the developer to the toner, and the interface between the developer and the toner is located at the boundary area B. Accordingly, when the TC ratio is the optimal value, a relatively small amount of toner is supplied to the developer. When the TC ratio is higher than the optimal value, the pressure applied from the developer to the toner is high, and almost no toner is supplied to the developer.

EXPERIMENTS

The inventors conducted the following experiments so as to prove that the developing device 7 has the advantages described above. More specifically, as a first experiment, the TC ratio was measured while toner images with coverage of 5% were continuously formed on sheets by use of the developing device 7, and the TC ratio was measured while toner images with coverage of 100% (solid images) were continuously formed on sheets by use of the developing device 7. The experiment was conducted under the following conditions: the carriers used had a weight of 50 g; the space Sp1 had a volume corresponding to the volume of the developer that contains 50 g of carriers and that has a TC ratio of 8%; and the boundary area B was in the shape of a rectangle of 10 mm by 250 mm.

Figure 5:
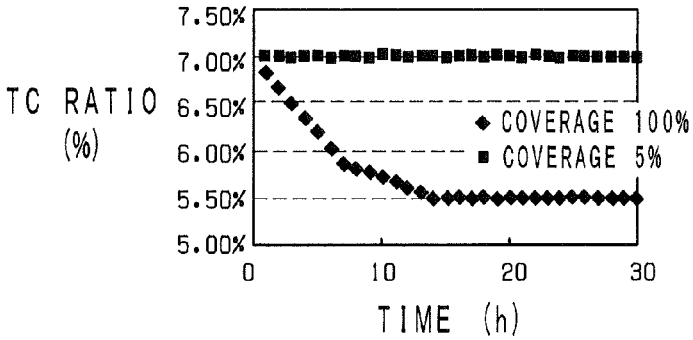
FIG. 5 is a graph showing results of a first experiment.

FIG. 5 is a graph showing results of the first experiment. In the graph, the y axis shows TC ratio, and the x axis shows time. As is apparent from FIG. 5, during the continuous toner image formation with coverage of 5%, the TC ratio was kept at 7%. During the toner image formation with coverage of 100%, the TC ratio fell, but the fall ceased at 5.5%. Hence, the results of the first experiment show that fluctuation of the TC ratio in the developing device 7 can be suppressed. Therefore, with the developing device 7, even while toner images with high coverage are formed continuously, paling of the toner images can be prevented.

Next, the inventors conducted a second experiment by use of the same developing device 7 as used in the first experiment. The second experiment started with toner image formation with coverage of 100% for a specified time (15 hours) and continued to toner image formation with coverage of 5%, and the TC ratio was measured throughout the toner image formation of the two kinds.

Figure 6:
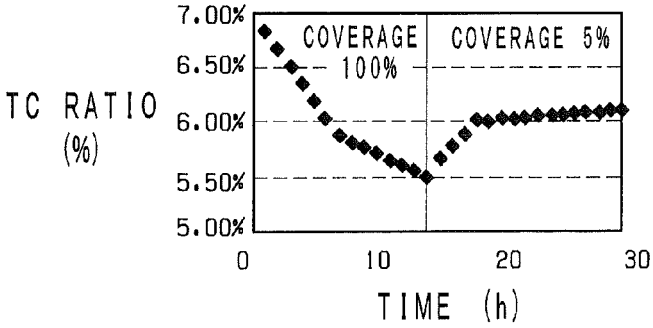
FIG. 6 is a graph showing results of a second experiment.

FIG. 6 is a graph showing results of the second experiment. In the graph, the y axis shows TC ratio, and the x axis shows time. As is apparent from FIG. 6, the TC ratio fell to 5.5% during the continuous toner image formation with coverage of 100%, but when the toner image formation with coverage of 5% started, the TC ratio rose drastically. Thus, the results of the second experiment show the following thing: in the developing device 7, when the TC ratio falls below the optimal value drastically, the toner supply speed increases, thereby resulting in a fast recovery of the TC ratio.

First Modification

Figure 7:
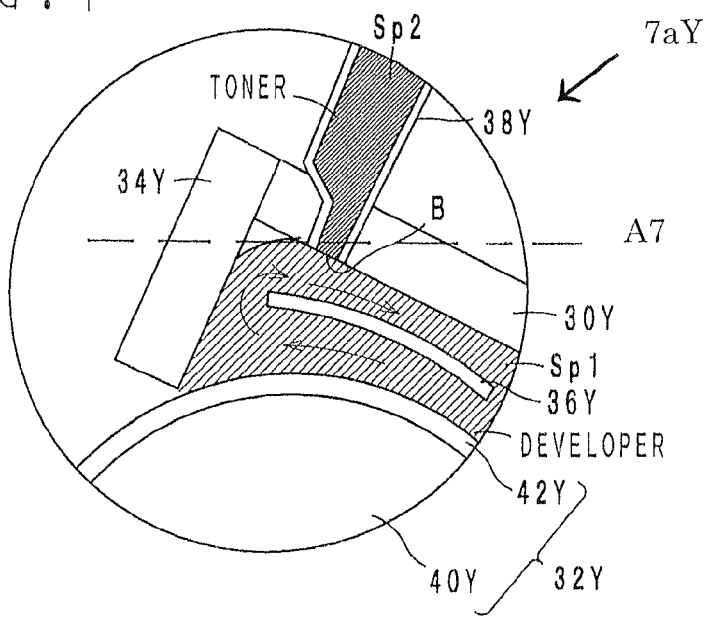
FIG. 7 is an enlarged view of a first modified developing device.

Next, a developing device of a first modification is described with reference to the drawings. FIG. 7 is an enlarged view of the first modified developing device 7*a*Y.

In the first modified developing device 7*a*Y, the boundary area B between the space Sp1 and the space Sp2 is located more downstream, with respect to the rotating direction of the sleeve 40Y, than the boundary area B in the developing device 7Y. In the developing device 7*a*Y, the boundary area B is opposed to the downstream end portion, with respect to the rotating direction of the sleeve 40Y, of the current plate 36Y. The boundary area B in the developing device 7*a*Y is located above the level of the boundary area B in the developing device 7Y. Accordingly, in the developing device 7*a*Y, the level difference between the boundary area B and the level of the developer surface A7 is small. Therefore, in the developing device 7*a*Y, a fall in the pressure applied from the developer to the toner at the boundary area B due to a fall in the TC ratio is larger than that in the developing device 7Y. Consequently, in the developing device 7*a*Y, in response to a fall in the TC ratio, the toner supply is started promptly.

Second Modification

Figure 8:
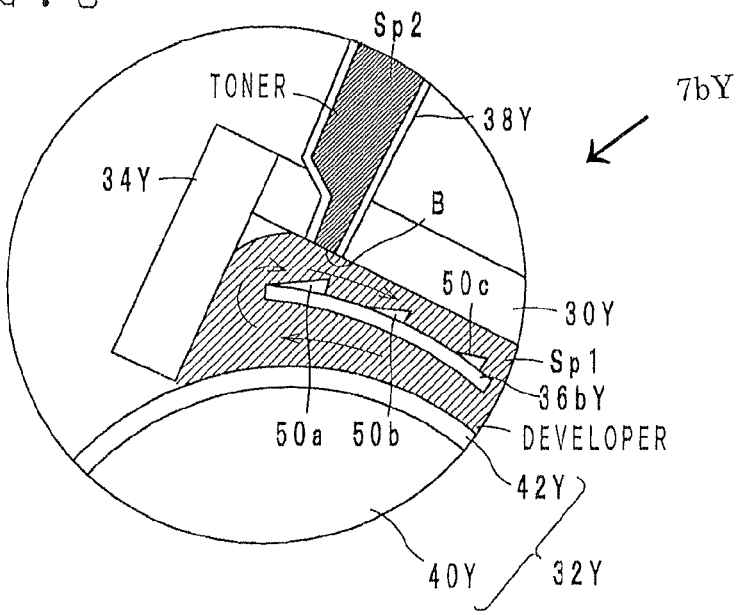
FIG. 8 is an enlarged view of a second modified developing device.
Figure 9:
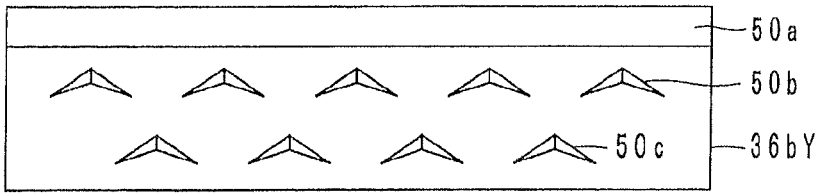
FIG. 9 is a plan view showing a current plate provided in the second modified developing device.
Figure 10:
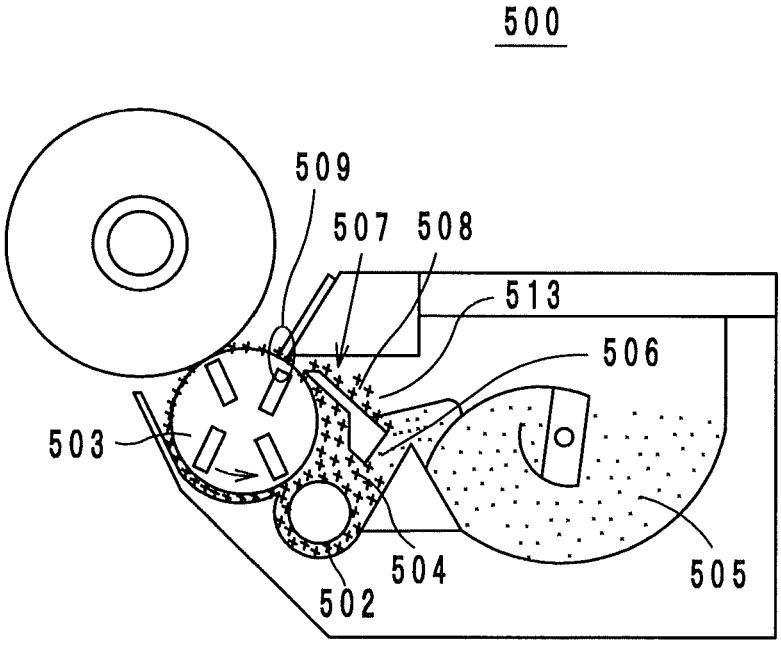
FIG. 10 PRIOR ART
FIG. 10 is a developing device disclosed by Japanese Patent Laid-Open Publication No. 2005-17935.

Next, a developing device of a second modification is described with reference to the drawings. FIG. 8 is an enlarged view of a second modified developing device 7*b*Y. FIG. 9 is a plan view of a current plate 36*b*Y provided in the second modified developing device 7*b*Y.

The current plate 36*b*Y has ribs 50*a* to 50*c* on the surface (upper surface) facing the boundary area B between the space Sp1 and the space Sp2. The rib 50*a* extends in a direction perpendicular to the rotating direction of the sleeve 40Y.

The rib 50*a* is opposed to the boundary area B. The plurality of ribs 50*b* are aligned in the direction perpendicular to the rotating direction of the sleeve 40Y at a position upstream, with respect to the rotating direction of the sleeve 40Y, from the rib 50*a*. The plurality of ribs 50*c* are aligned in the direction perpendicular to the rotating direction of the sleeve 40Y at a position upstream, with respect to the rotating direction of the sleeve 40Y, from the ribs 50*b*. The ribs 50*b* and the ribs 50*c* are staggered along the direction perpendicular to the rotating direction of the sleeve 40Y.

With the provisions of the ribs 50*a* to 50*c* to the current plate 36*b*Y, the developer flowing on the current plate 36*b*Y is troubled by the ribs 50*a* to 50*c*. Thereby, the developer is stirred more effectively.

In either of the developing devices 7Y, 7*a*Y and 7*b*Y, the boundary area B is present at one location. However, there may be two or more boundary areas B in such a developing device. In this case, it is preferred that all the boundary areas B are closed by a developer or toner.

Although the present invention has been described in connection with the preferred embodiment above, it is to be noted that various changes and modifications are possible to those who are skilled in the art. Such changes and modifications are to be understood as being within the scope of the invention.

What is claimed is:

1. A developing device for forming a toner image on an image support member with a developer composed of toner and carriers, said developing device comprising:

a main body in which a first space for a developer is made;

a developer support member, which is located in the first space, for supporting the developer and for supplying toner of the developer to the image support member; and a toner tank in which a second space for toner is made, the second space leading to the first space via at least one boundary area;

wherein the at least one boundary area between the first space and the second space is closed by the toner or the developer;

wherein the at least one boundary area between the first space and the second space is located above a center of the developer support member;

wherein the developer support member is a developing roller that rotates in a specified direction;

wherein the developing device further comprises a blade, which is located upstream, with respect to the specified direction, from a closest point where the developing roller and the image support member are closest to each other, for regulating a developer layer supported on a peripheral surface of the developing roller to a specified thickness; and wherein the at least one boundary area between the first space and the second space is located upstream, with respect to the specified direction, from the blade.

2. A developing device according to claim 1, further comprising a current plate provided in the first space along the peripheral surface of the developing roller:

wherein there is a gap between a downstream end, with respect to the specified direction, of the current plate and the blade;

wherein the at least one boundary area between the first space and the second space is located between a first vertical line passing the downstream end, with respect to the specified direction, of the current plate and a second vertical line that is the farthest from the first vertical line among vertical lines passing the current plate.

3. A developing device according to claim 1, wherein the current plate has a rib on a surface facing the boundary area between the first space and the second space.

4. A developing device according to claim 1, wherein in the boundary area between the first space and the second space, the second space is located on top of the first space.

* * * * *